United States Patent [19]

Wall

[11] 4,226,251

[45] Oct. 7, 1980

[54] HAIRBRUSH CONSTRUCTION

[76] Inventor: Albert Wall, 515 S. Crescent Ave., Lodi, Calif. 95240

[21] Appl. No.: 14,648

[22] Filed: Feb. 23, 1979

Related U.S. Application Data

[63] Continuation of Ser. No. 803,359, Jun. 3, 1977, abandoned.

[51] Int. Cl.[2] ..... A45D 44/18

[52] U.S. Cl. ..... 132/85

[58] Field of Search ..... 132/85, 9, 123–124, 132/144, 112; 15/184, 193, 201, 159, 187, 169, 201

[56] References Cited

U.S. PATENT DOCUMENTS

| | | | |
|---|---|---|---|
| 3,059,260 | 10/1962 | Peilet | 15/184 |
| 3,101,086 | 8/1963 | DiVito | 132/DIG. 3 |
| 3,421,522 | 1/1969 | Magguilli | 132/11 R |

*Primary Examiner*—G. E. McNeill

*Attorney, Agent, or Firm*—Flehr, Hohbach, Test, Albritton & Herbert

[57] ABSTRACT

A hairbrush construction having an elongate body with a grip portion thereof for holding and manipulating the brush and employs bristle elements carried by the body to extend away from one side. A tapered end portion is carried at the leading end of the body and serves to readily enter, gradually separate and lift a shock of hair of a person as the end portion passes into the hair. The end portion is tapered as viewed in both elevation and plan to form a substantially pointed end to the entering portion. In one embodiment the end portion is readily releasably coupled to the end of the body and can be disposed in a plurality of positions relative thereto. According to another embodiment the hairbrush includes a bristle unit carried in a receiver portion of the body so as to move between readily projected and retracted positions relative to the body of the brush.

3 Claims, 21 Drawing Figures

FIG_1
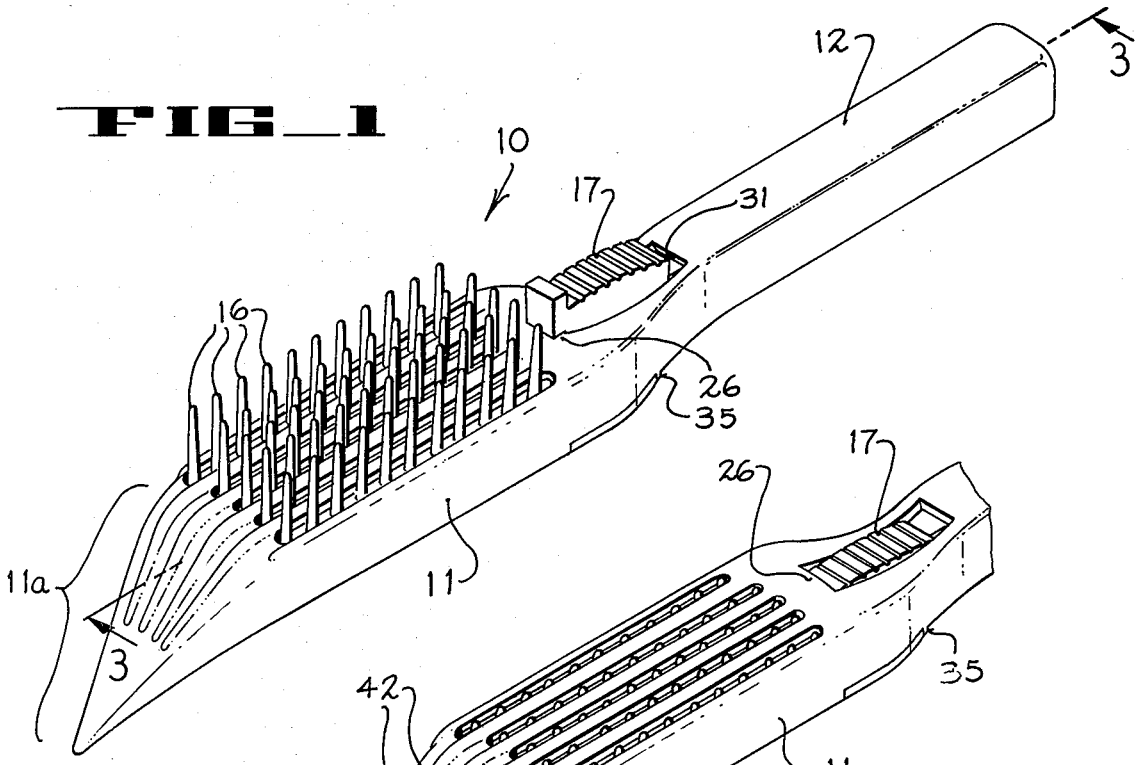
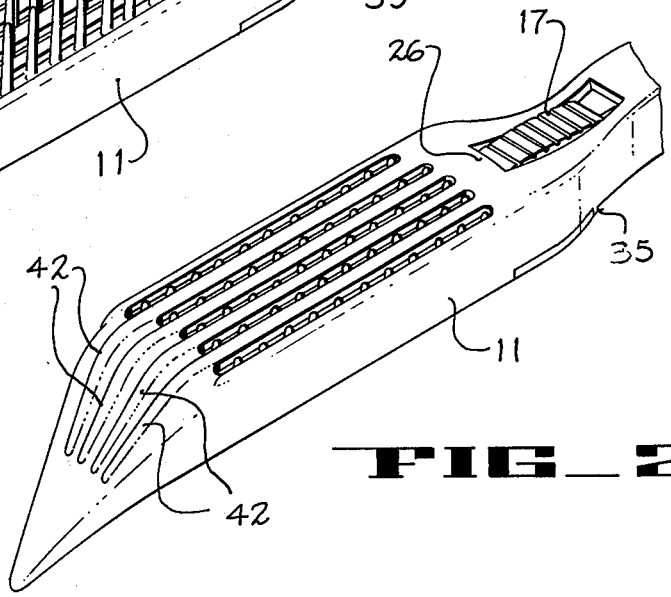
FIG_2
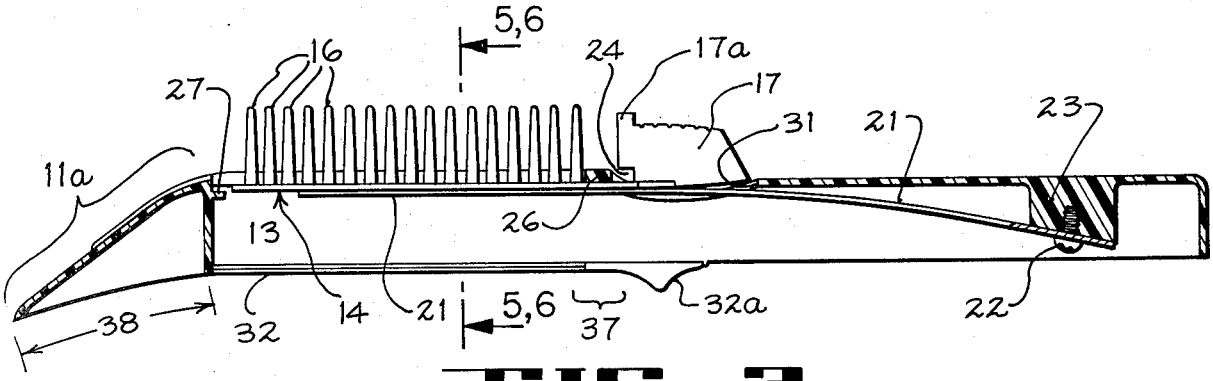
FIG_3

FIG_4
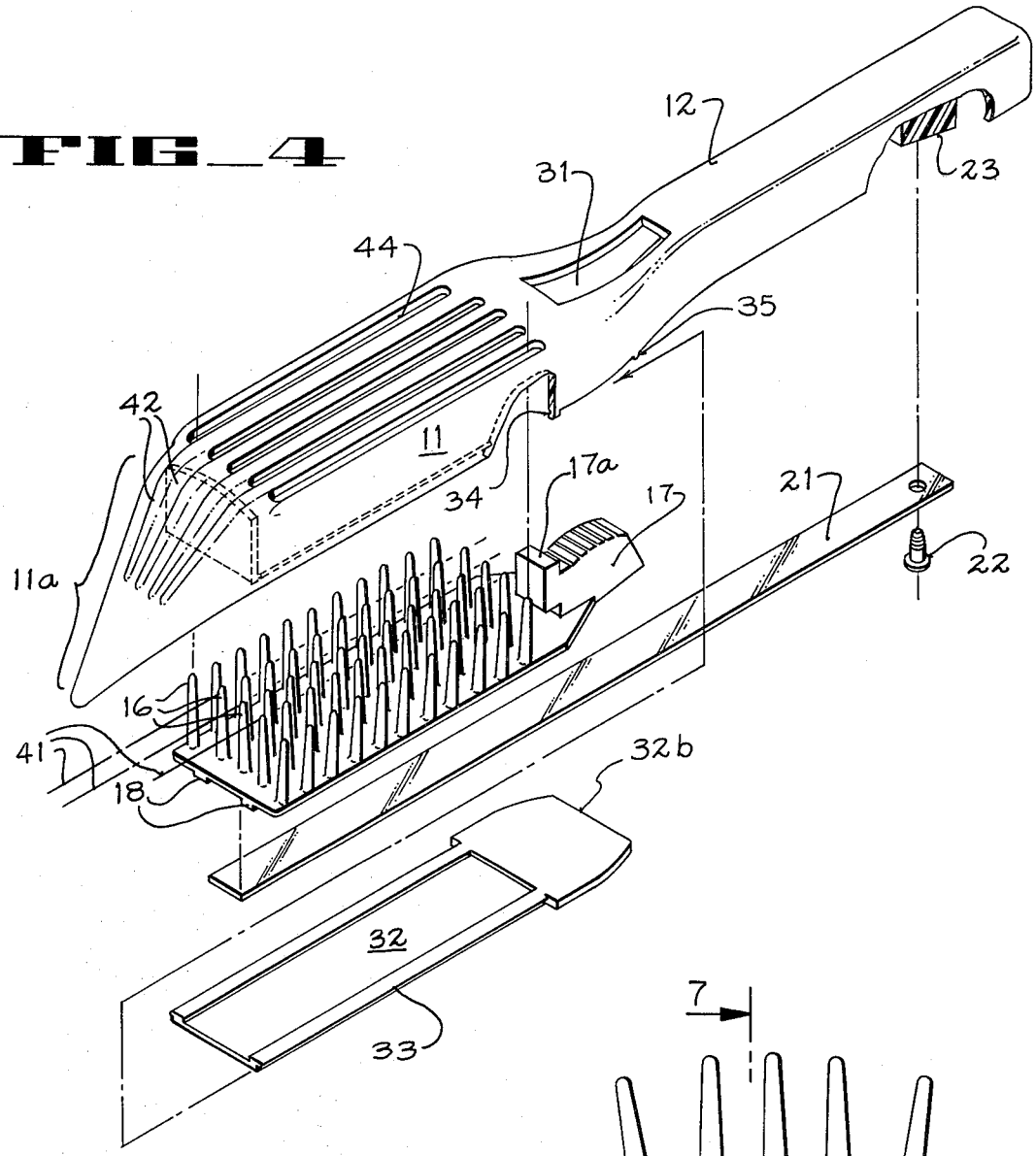
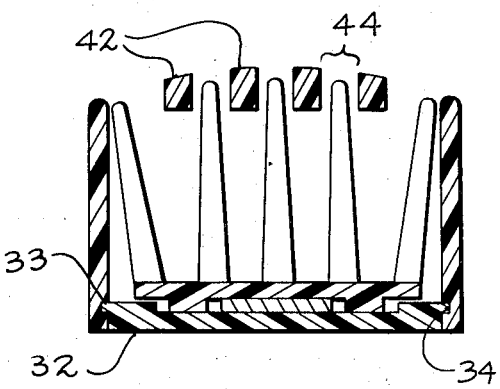
FIG_5
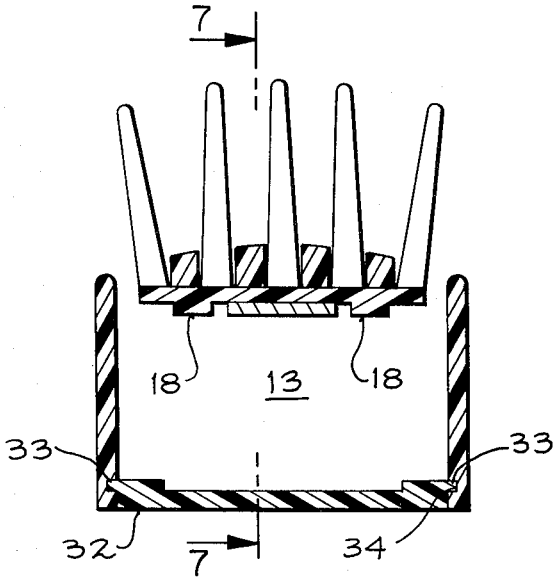
FIG_6

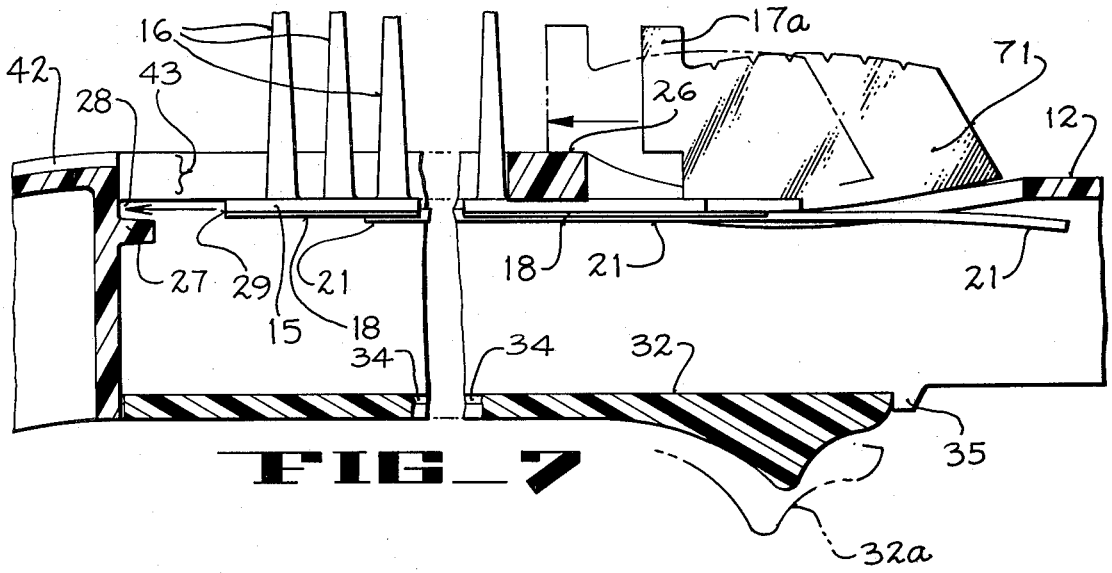
FIG_7
FIG_8
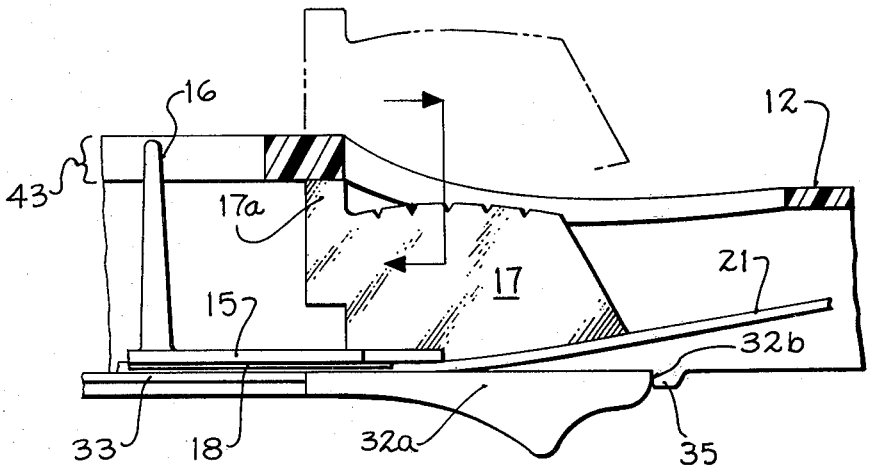
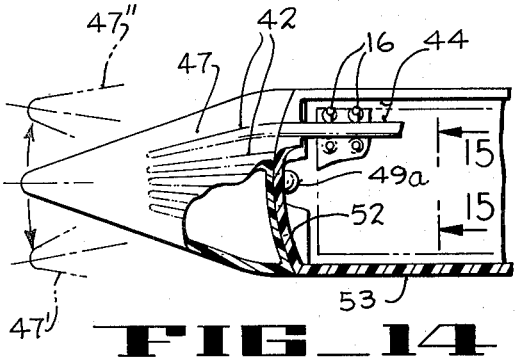
FIG_14
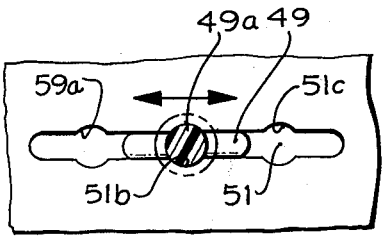
FIG_15

HAIRBRUSH CONSTRUCTION

This is a continuation of application Ser. No. 803,359 filed June 3, 1977 now abandoned.

BACKGROUND OF THE INVENTION

This invention pertains to an improved hairbrush of a type for use in conjunction with hand-held blowers or hair dryers and characterized by means serving to shield the bristles to permit the brush to penetrate into the hair.

Hair stylists typically are required to pursue a series of somewhat awkward manipulations or movements in drying wet hair by means of hand-held blowers while styling the hair at the same time.

For example, one routine commonly used follows the steps of first lifting a shock of hair by means of a finger on one hand and placing the elongate barrel of the dryer under the lifted shock of hair to support the hair away from the head so that a brush can be positioned between the lifted shock of hair and the head. The stylist then positions a brush and removes the blower so as to use the brush in supporting the shock of hair. The stylist then employs the brush for styling the hair as the blower is used to dry the hair in cooperation with the brush. The foregoing steps are continuously repeated in the styling of any given head of hair and become somewhat tiresome to the operator.

Accordingly, there has been a need for an improved hairbrush construction which can more readily assist the stylist in working with a hand-held blower.

SUMMARY OF THE INVENTION AND OBJECTS

In general, there has been provided an improved hairbrush construction comprising an elongate body including a grip portion for holding and manipulating the brush. Bristle elements carried by the body extend away from one side and a tapered end portion is carried at the leading end of the body for readiy entering, gradually separating and lifting a shock of hair of a person as the end portion passes into the hair. The end portion is tapered as viewed in both elevation and plan to form a substantially pointed end.

In general, it is an object of the present invention to provide an improved hairbrush construction in which the bristles are protected sufficiently to permit the brush to be inserted into the hair.

It is a further object of the present invention to provide such a brush construction having means for positively locking the bristles in either a projected or retracted position thereof in respone to forward movement of an operating portion of the bristle unit.

A further object of the present invention is to provide a brush construction of the kind described characterized by a tapered end portion for easily entering and separating a shock of hair and including a number of elongate shallow ribs for supporting hair thereacross spaced from the outer surface of the brush.

Another object of the invention is to provide an improved hairbrush having means forming an arresting barrier on the back of the hairbrush to inhibit movement along the back of the brush of hair strands lying thereacross.

The foregoing and other objects of the invention will become more readily evident from the following detailed description when considered in conjunction with the drawings.

BRIEF DESCRIPTION OF THE DRAWINGS

FIG. 1 shows a diagrammatic perspective view of a hairbrush construction, according to the invention, with the bristles in their projected position.

FIG. 2 shows a diagrammatic perspective view of a portion of the brush construction shown in FIG. 1 but with the bristles withdrawn.

FIG. 3 shows a side elevation section view of the brush construction of FIG. 1 taken along the line 3—3 thereof.

FIG. 4 shows an exploded diagrammatic perspective view of a hairbrush construction according to the invention.

FIG. 5 shows a transverse sectional view taken along the lien 5—5 of FIG. 3 with the bristle unit in its retracted position.

FIG. 6 shows a transverse sectional view taken along the line 6—6 of FIG. 3 with the bristle unit in its projected position.

FIG. 7 shows an enlarged side elevation section view taken along the line 7—7 of FIG. 6.

FIG. 8 shows an enlarged detail view in side elevation section of a portion of FIG. 7 showing the bristles in a retracted position and means for locking same in said retracted position.

FIG. 14 shows a plan view partially broken away showing a removable end portion for a brush construction of the kind described according to the invention.

FIG. 15 shows an enlarged elevation detail view with portions shown in section for clarity taken along the line 15—15 of FIG. 14.

DETAILED DESCRIPTION OF PREFERRED EMBODIMENTS

Figure 9:
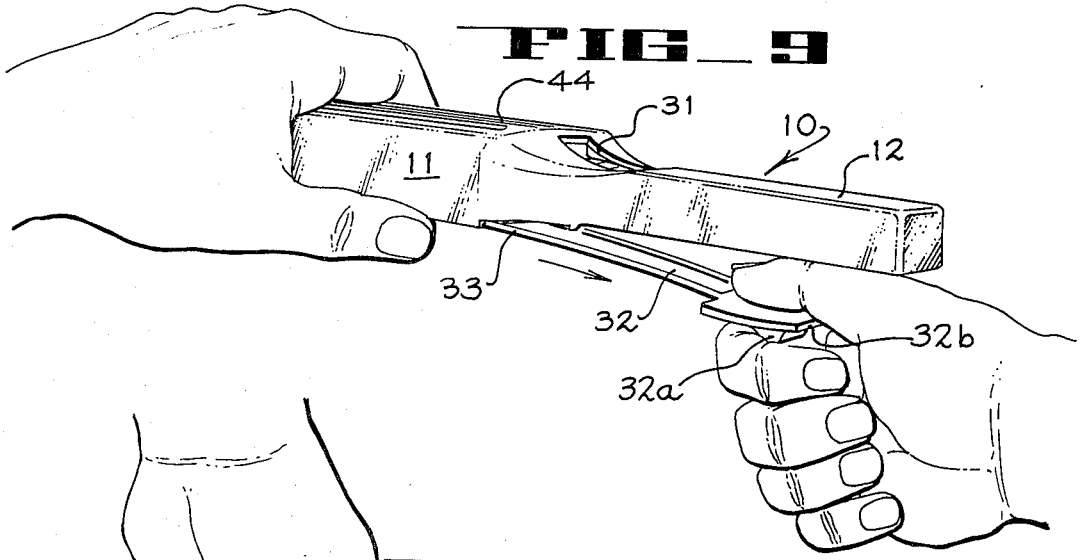
FIG. 9 shows a diagrammatic perspective view of the first step involved in removing a given bristle unit from the brush.

As shown in FIGS. 1 and 2, a hairbrush construction 10 includes an elongate body 11 including a grip portion 12 for holding and manipulating the brush.

As shown best in FIG. 3, a portion 13 of body 11 is hollow and disposed to form a receiver for containing a bristle unit 14 therein.

Bristle unit 14 is carried in receiver 13 to move between radially projected and retracted positions relative to the outer surface of body 11. Accordingly, each bristle unit 14 includes a support base 15, a plurality of rows of bristle elements 16 carried by base 15 and a push button 17 carried by base 15 to move with the base and bristles radially inwardly of body 11. The underside of base 15 includes a pair of elongate ribs 18 defining a channel 19 therebetween for receiving a leaf spring 21.

Means for selectively moving bristle unit 14 between retracted and projected positions includes the elongate leaf spring 21 anchored at one end to the tapered mounting surface of mounting block 23 by fastening means such as the screw 22 with spring 21 in channel 19, the distal end of spring 21 urges bristle unit 14 upwardly (as shown in FIG. 3) to cause bristle elements 16 to protrude outwardly of body 11.

Means are provided for locking bristle unit 14 in its projected position so as to permit the hairbrush construction to be used in the normal manner. Accordingly, push button 17 is formed with a detent 24 or a notch for engaging a portion of the edge margin or lip 26 defined about opening 31.

Accordingly, as bristle unit 14 is urged forwardly by means of push button 17, the rear end of unit 14 becomes positively engaged by the interaction of detent 24 and lip 26. Further, means are provided for positively interlocking the leading end of bristle unit 14 with the brush structure. Thus, as shown best in FIGS. 3 and 7, a transversely extending front support ledge 27 defines a detent slot 28 immediately beneath the top of body 11 for receiving the leading end edge 29 of support base 15.

Push button 17 is disposed within a rectangular opening 31 whereby push button 17 (and the remainder of bristle unit 14) can be depressed against the radially outward urging of spring 21.

Means are provided for locking unit 14 in its retracted position within hollow receiver portion 13 as now to be described. The upper surface of push button 17 includes an upwardly protruding knob 17*a*. After push button 17 has been fully depressed downwardly against spring 21, the top surface of knob 17*a* lies at a level immediately beneath the undersurface of lip 26 whereby upon urging push button 17 forwardly, knob 17*a* becomes disposed immediately beneath lip 26. Releasing push button 17 permits the urging of spring 21 to provide positive engagement between knob 17*a* and the undersurface of lip 26. Thus, bristle unit 14 is positively retained in its retracted position by the forward movement of knob 17*a* to a position beneath lip 26.

Means for limiting the downward movement of spring 21 in response to depressing push button 17 includes the readily removable closure panel 32 carried by body 11. Protruding side rails 33 extend into elongate slots 34 formed into the side walls of body 11. As thus arranged closure panel 32 lies behind bristle unit 14 and serves to arrest downward movement of spring 21 and unit 14 when moved to their retracted position.

Means for readily releasably retaining panel 32 in place comprises a pair of downwardly extending detents 35 formed at the edges of body 11 (FIG. 7). The trailing edge 32*b* of panel 32 engages detents 35. Since body 11 is hollow, a person's finger can easily reach across edge 32*b* and onto the upper surface of panel 32 to draw edge 32*b* out of engagement with detents 35. Panel 32 further includes a finger grip portion 32*a* for use in holding the brush and for withdrawing panel 32.

Closure panel 32 when slidably removed serves to permit unit 14 and spring 21 to be moved out of receiver 13 so as to permit removal of unit 14. Note, for example, FIGS. 9 and 10.

Figure 10:
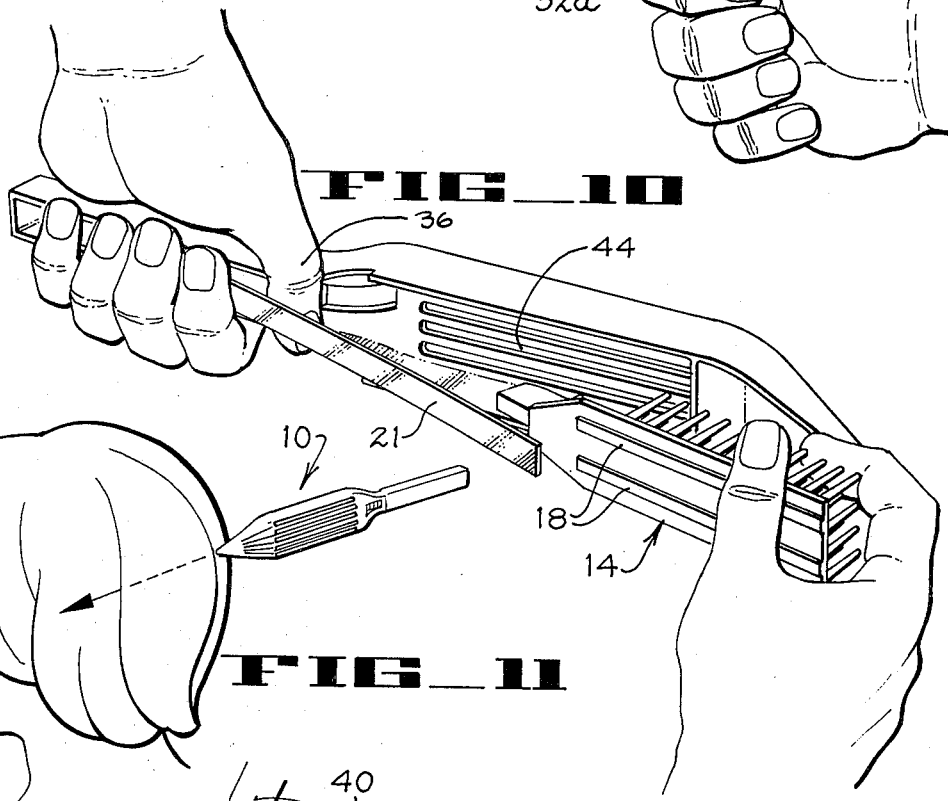
FIG. 10 shows a diagrammatic perspective view in which the bristle unit is being removed.
Figure 11:
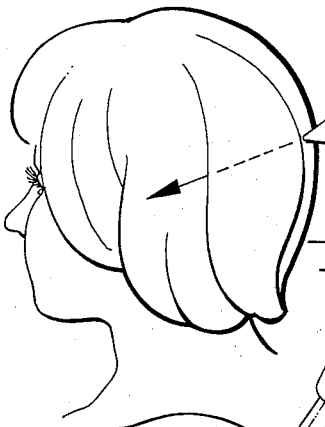
FIG. 11 shows a diagrammatic perspective view of a brush of the kind described with its bristles retracted and being inserted into a shock of hair to be styled.
Figure 12:
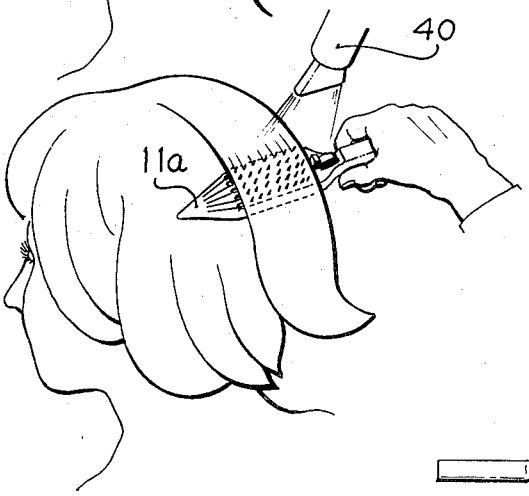
FIG. 12 shows a view similar to that of FIG. 11 but with the brush inserted and the bristle elements moved to their projected position for cooperation with an air blower.
Figure 13:
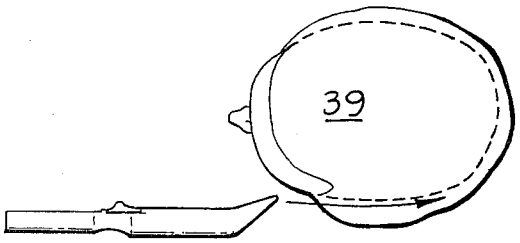
FIG. 13 shows a diagrammatic plan view illustrating how the underside of the brush construction conforms to the curvature of a person's head.

With respect to FIGS. 9 and 10, panel 32 is first withdrawn so as to permit a person to thereafter depress push button 17 and spring 21 sufficiently to permit a person's thumb 36 (or other digit) to be inserted between spring 21 and body 11 and thereby open the bottom of receiver 13 sufficiently to permit bristle unit 14 to be withdrawn. Brush construction 10 is formed to conform substantially to the curvature of a person's head. As shown best in FIGS. 3 and 13, body 11 of brush construction 10, as shown in side elevation with the bristle side on top includes an unobstructed generally smooth bottom profile extending from the leading end of body 11 rearwardly to a position 37 substantially underlying the rearward end of bristle unit 14. That portion of the foregoing profile associated with end portion 11*a* is formed with a curvature 38 adapted to conform substantially to the average curvature of a person's head 39 as observed from above, as in FIG. 13.

Bristle unit 14, as shown, includes a plurality of rows 41 of bristle elements 16. Rows 41 are disposed to extend radially outwardly of unit 14. Elongate ribs 42 are disposed to extend between pairs of rows 41 and extend forwardly onto the outer surface of the leading end portion 11*a* of body 11. Ribs 42 are raised slightly above the surface of end portion 11*a* sufficiently to support hair lying across ribs 42 in a position free of substantial contact with the underlying surface so as to increase air circulation adjacent the ribs.

With bristle unit 14 disposed in its projected position, as shown best in FIGS. 3 and 7, support base 15 will lie immediately beneath, if not in contact with, the underside of ribs 42 to define a plurality of elongate shallow slots 43 of a depth corresponding to the height of said ribs 42. Thus, ribs 42 serve to define openings 44 along body 11 defined between adjacent ribs for accommodating passage of individual bristle elements 16 therethrough while at the same time defining shallow slots for each row 41 of bristle elements 16 when disposed therethrough.

By providing the raised ridges on the leading end portion of body 11 by means of ribs 42 and by providing the shallow slots 43 in the manner above described, the flow of air from an air gun 40, or the like directed across the brush will be prevented from becoming a laminar flow due to the "spoiling" effect of the irregular surfaces created by ribs 42.

It has been observed that when directing a flow of air from an air gun across a conventional brush having a rounded surface and when syling hair in a wet condition the layer of hair adjacent the brush will have a tendency to adhere to the brush due to the influence of the laminar flow of air thereacross. As shown with regard to FIGS. 1 and 2, ribs 42 serve to break up such laminar air flow and make the hair more manageable as well as providing additional circulation of air about the hair.

It has been further observed that in styling hair one particular manipulation of the hair which is relatively common is the separation of the hair along a given line. As is shown herein in FIG. 14, a selectively positionable tapered end unit 47 having a configuration comparable to that shown in FIGS. 1 through 3 is provided in which unit 47 comprises a component independent of body 53. Means for readily releasably coupling unit 47 to body 53 to be disposed selectively at a plurality of positions with respect to the axis of the body 11 includes a rearwardly protruding lug 49 extending from the unit 47. Lug 49 extends through an elongate slot 51 formed in the curved loading wall 52 of body 53. Slot 51 includes a plurality of detent openings 51*a*–51*c* for engaging a rounded portion 49*a* of lug 49 in each of a plurality of three positions associated with the positioning of the end unit 47.

Unit 47 can be detached from or attached to wall 52 simply by forcing portion 49*a* through one of the detent openings 51*a*–51*c*. The hollow underside of body 11 permits easy access for a person's finger to engage portion 49*a*.

From the foregoing, it will be readily evident that there has been provided an improved hairbrush for styling and for working in cooperation with an air blower. The hairbrush can be simply inserted into a shock of hair so as to lift the hair and permit the use of an air blower directly thereagainst without having to substitute the step of interposing the barrel of the blower to support the shock of hair as lifted. By eliminating the foregoing step of having to introduce the barrel of the blower in supporting relation to the shock of hair that has been moved away from the head known problems involved with drawing hair into the adjacent intake of the blower are also eliminated.

In short, the tapered end portion of the brush construction serves to accomplish a saving in manipulative steps which would otherwise need to be employed.

In addition, an improved bristle unit has been provided which can be readily removed for cleaning or replacement by another bristle unit having differently spaced bristle elements. Further, the ribs provided in the construction serve to provide means for "spoiling" any laminar air flow to minimize problems which have previously been caused by this type of air flow.

Finally, it should be readily evident that a brush construction of the kind described can readily be carried in a purse with the bristles retracted and positively locked in a withdrawn condition.

From the foregoing description it should be readily evident that a hairbrush construction of the kind described above provides means for shielding the bristles of the brush as the brush is being inserted into the hair to protect the bristles from becoming entangled in the hair as the brush is being moved into position. The pointed end of the brush serves to assist in permitting the brush to easily enter the hair with the bristles retracted.

Additional embodiments, as now to be described, serve to permit the brush to readily enter the hair relatively free of substantial entanglement with the hair as the brush is inserted.

Figure 16:
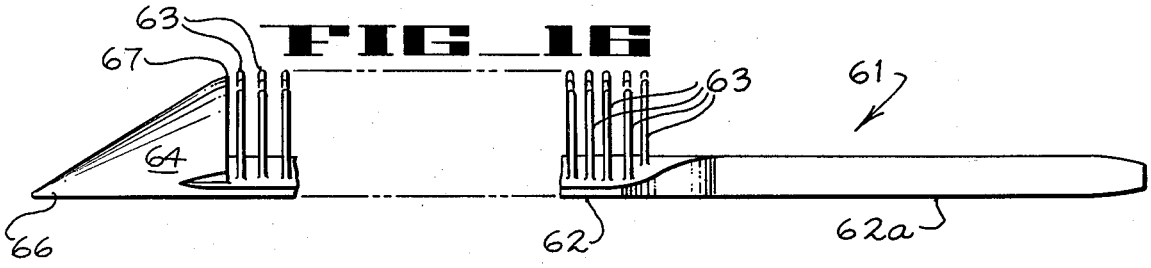
FIGS. 16 and 17 respectively show side elevation and plan view of a hairbrush construction according to another embodiment of the invention.

Accordingly, as shown in FIG. 16, a hairbrush construction 61 comprises an elongate body 62 including a grip portion 62*a* for holding and manipulating the hairbrush. Bristle elements 63 carried by body 62 extend away from one side of body 62. For purposes of explanation, the side of hairbrush construction 61 from which bristle elements 63 extend can be considered to be the "front" side and the reverse side considered the "back" side.

Figure 17:
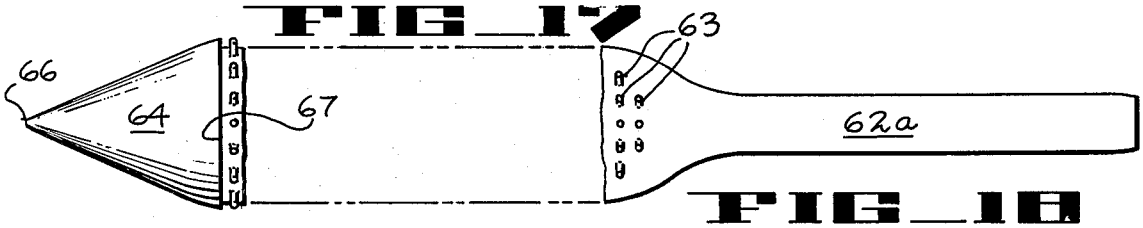
Figure 18:
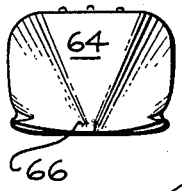
FIG. 18 shows an end elevation view of the embodiment shown in FIGS. 16 and 17.

Means serving to shield bristle elements 63 so as to permit the end of the hairbrush to be inserted into the hair substantially free of entanglement with bristles 63 comprises a tapered end portion 64 carried at the leading end of body 62 and serving to readily enter, gradually separate and lift a shock of hair of a person as the end portion 64 passes into the hair. End portion 64 is tapered as viewed in both elevation and plan (note FIGS. 16 and 17) to form a substantially pointed end 66 thereto.

In order to shield bristles 63, the taper of end portion 64 as viewed in elevation extends sufficiently radially away from body 62 to protectively shield bristle elements 63 at the entering end of the brush. Accordingly, the trailing end edge 67 of portion 64 protrudes radially from body 62 to a position substantially co-extensive with the radially outer ends of bristles 63.

As thus arranged, the tips of bristle 63 are disposed to lie in protected relation behind end portion 64.

As shown in FIG. 16, end portion 64 forms an integral part of body 62.

Figure 19:
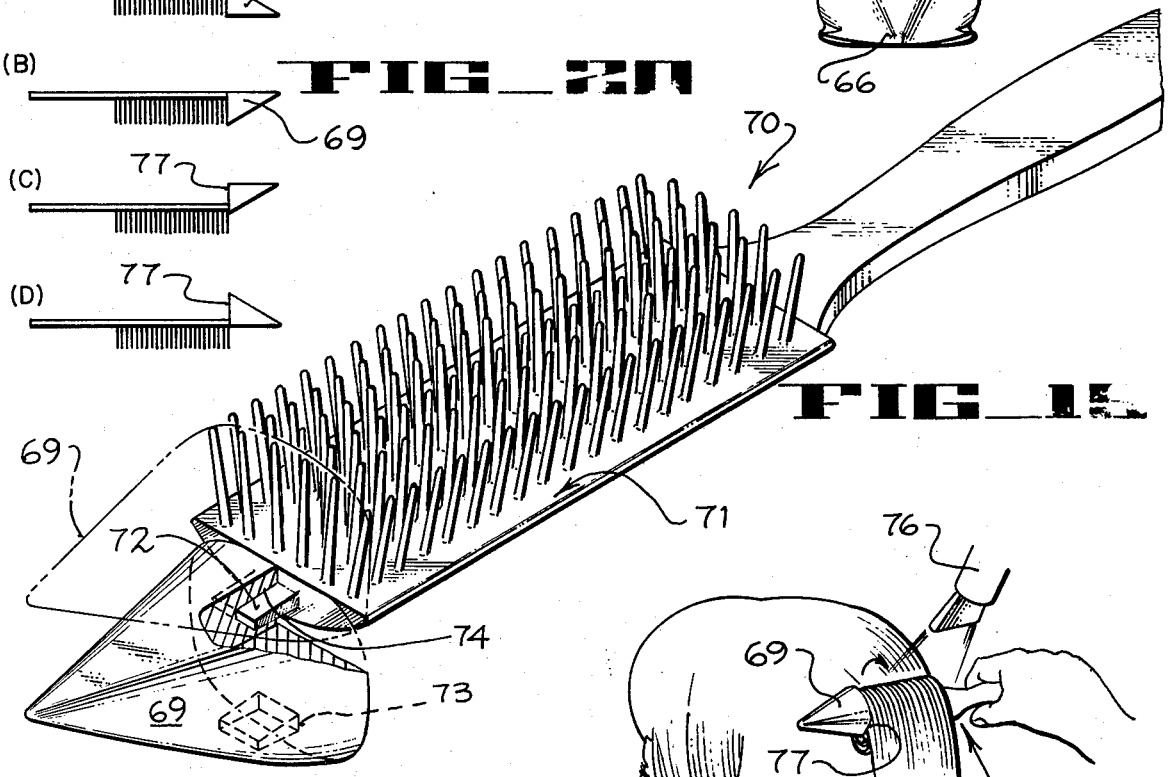
FIG. 19 shows a diagrammatic perspective view with a portion broken away for clarity of another embodiment of the invention.

According to another embodiment as shown in FIG. 19, an end portion 69 forms a separable unit from body 71. Means for readily releasably securing end portion 69 to body 71 is diagrammatically shown as including a protruding tongue 72 formed to engage and be retained in one or the other of a plurality of similarly shaped openings 73, 74 in end portion 69.

Figure 20:
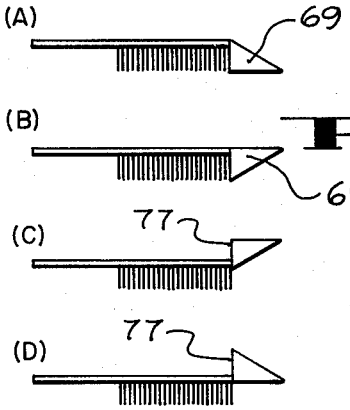
FIG. 20 shows diagrammatically four arrangements of the embodiment shown in FIG 19.

End portion 69, as viewed in elevation, provides something of a right triangular profile wherein the longer leg of the triangle forms a continuation of the line of body 71 as shown in FIGS. 20 (B) and (D).

By using a tongue 72 having a truncated wedge configuration, end portion 69 can be secured to tongue 72 using a friction fit (as shown) in any one of the four positions shown in FIG. 20. For example, when attaching end portion 69 to the hairbrush construction in the manner as shown in FIG. 20 (A) the hairbrush tends to lift the maximum amount of hair. At the same time, a minimum amount of hair will be lifted employing the construction shown in FIG. 20 (B).

As shown in FIGS. 20 (C) and (D), the end portion 69 has been attached in a position to provide means protruding radially away from the back of the body to form a barrier for arresting movement along the back of the body of strands of hair lying across the back.

Figure 21:
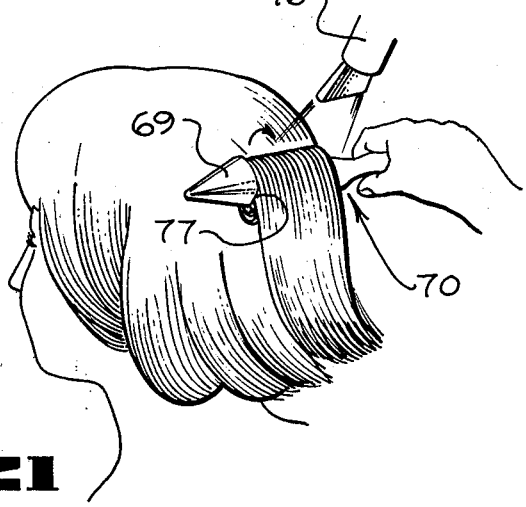
FIG. 21 shows a diagrammatic perspective view of one manner of using one of the embodiments such as the embodiment shown in FIG. 19.

In styling hair, the hairbrush construction is employed for purposes of brushing the strands of hair. The brush is also employed as a support across which the strands of hair can be mounted as a blower 76 is directed against these strands for purposes of drying and styling them. Such a blower is shown at 76 in FIG. 21 wherein the brush construction 70 is being rolled beneath a shock of hair. A problem in drying the hair as it lies on the back of a brush has been that the hair tends to be blown off that end of the brush opposite the grip portion. Accordingly, as arranged in FIGS. 20 (C) and (D), an arresting barrier 77 is formed by the manner in which end portion 69 is positioned onto tongue 72.

Provision of this arresting barrier 77 serves to permit the hair stylist to save considerable time in not having to repetitively recapture hair which is blown over the end of the brush.

Accordingly, a portion of end portion 69 extends away from the back surface of body 71 to form a barrier 77 for arresting lateral movement of hair lying across the back of body 71. More particularly, the means for readily releasably securing end portion 69 to body 71 serves to dispose a portion of end portion 69 to protrude away from the back of body portion 71 to form barrier 77 for arresting lateral movement of hair along body 71.

I claim:

1. A hairbrush comprising an elongate body including a bristle portion carried by said body, a bristle-free, elongate grip portion at one end of said body of sufficient length to be readily held in the hand of a person using the brush for manipulating the brush, a bristle-free end portion separate from and protruding axially away from said bristle portion adjacent thereto at the other end of said body, the last named said end portion being tapered as viewed in elevation and plan to a degree sufficient to shield the bristles of the adjacent end of said bristle portion to permit said adjacent end of said bristle portion to enter a shock of hair to be brushed, while said grip portion is held for manipulating said brush, said grip portion and said end portion being disposed at opposite ends of said bristle portion to permit said grip portion to be readily held in a person's hand while inserting said tapered end portion into the hair.

2. A hair brush comprising an elongate body including a grip portion at one end of said body for manually holding and manipulating the brush, a bristle portion carried by said body, an elongate end portion at the other end of said body extending in advance of the bristle portion, said end portion being sufficiently tapered as viewed in elevation and plan to readily deflect and shield a person's hair from the otherwise exposed bristles of said bristle portion from substantial entanglement with the person's hair.

3. A hair brush comprising an elongate body including a bristle-free grip portion at one end for manually holding and manipulating the hairbrush, a bristle-free end portion carried at the other end of said body serving to readily enter, gradually separate and lift a shock of hair as said end portion passes into a shock of hair, and exposed bristle elements carried by said body to extend away from one side of said body, said bristle elements being disposed between said grip portion and said end portion, said end portion being tapered as viewed in plan to spread the hair to a degree permitting said otherwise exposed bristle elements to readily move into the hair shielded by said end portion in advance thereof, substantially free of entanglement with the hair.

* * * * *